US007275594B2

(12) United States Patent
Hall et al.

(10) Patent No.: US 7,275,594 B2
(45) Date of Patent: Oct. 2, 2007

(54) STAB GUIDE

(75) Inventors: David R. Hall, Provo, UT (US); James McPherson, Sandy, UT (US); Patrick Hannigan, Salt Lake City, UT (US)

(73) Assignee: IntelliServ, Inc., Provo, UT (US)

( * ) Notice: Subject to any disclaimer, the term of this patent is extended or adjusted under 35 U.S.C. 154(b) by 207 days.

(21) Appl. No.: 11/161,316

(22) Filed: Jul. 29, 2005

(65) Prior Publication Data

US 2007/0023190 A1 Feb. 1, 2007

(51) Int. Cl.
*E21B 17/10* (2006.01)

(52) U.S. Cl. ..... 166/241.1; 166/227; 166/242.1; 175/314; 285/27

(58) Field of Classification Search ..... 166/243, 166/227, 241.1, 242, 242.1; 175/314; 285/24, 285/27
See application file for complete search history.

(56) References Cited

U.S. PATENT DOCUMENTS 1,840,747 A * 1/1932 Sniffin et al. ..... 166/213
2,414,719 A 1/1947 Cloud
2,847,075 A * 8/1958 Halbrook et al. ..... 166/241.5
3,051,254 A * 8/1962 McClinton ..... 175/257
3,079,177 A * 2/1963 Garlington et al. ..... 285/27
3,215,201 A * 11/1965 Lacy et al. ..... 166/352
3,292,694 A * 12/1966 Lacy et al. ..... 166/358
3,352,574 A * 11/1967 Brian ..... 285/3
3,447,829 A 6/1969 Gyongyosl
3,518,608 A 6/1970 Papadopouloa
4,295,527 A 10/1981 Rüsse
4,495,073 A * 1/1985 Beimgraben ..... 210/448
4,739,325 A 4/1988 MacLeod
4,788,544 A 11/1988 Howard
6,012,015 A 1/2000 Tubel
6,252,518 B1 6/2001 Laborde
6,360,633 B2 3/2002 Pietras
6,392,317 B1 5/2002 Hall et al.
6,670,880 B1 12/2003 Hall et al.
6,688,396 B2 2/2004 Floerke et al.
6,717,501 B2 4/2004 Hall et al.
6,799,632 B2 10/2004 Hall et al.
6,821,147 B1 11/2004 Hall et al.
6,830,467 B2 12/2004 Hall et al.
6,834,892 B2 12/2004 Kornau et al.
6,844,498 B2 1/2005 Hall et al.
6,866,306 B2 3/2005 Boyle et al.

(Continued)

OTHER PUBLICATIONS

PCT/US03/15475, Published Dec. 4, 2003, Applicant Baker Hughes; International Search Report; "Documents Considered to Be Relevant".

*Primary Examiner*—William Neuder
*Assistant Examiner*—Nicole A Coy
(74) *Attorney, Agent, or Firm*—Jeffrey E. Daly; Tyson J. Wilde

(57) ABSTRACT

A tool string stab guide for axially aligning first tool string components with second tool string components is disclosed. The stab guide has a body with an axial length along a longitudinal axis with a first and a second section. The first section of the body adapted for removable attachment within a diameter of a bore of a tool string component. The second section of the body has a centering element with a flow channel. The ratio of the axial length to the diameter is at least 2:1.

22 Claims, 13 Drawing Sheets

U.S. PATENT DOCUMENTS 6,888,473 B1 5/2005 Hall et al.
6,913,093 B2 7/2005 Hall et al.
6,929,493 B2 8/2005 Hall et al.
6,945,802 B2 9/2005 Hall et al.
7,140,443 B2 * 11/2006 Beierbach et al. ..... 166/380
2004/0039466 A1 2/2004 Lilly et al.
2004/0104797 A1 6/2004 Hall et al.
2004/0113808 A1 6/2004 Hall et al.
2004/0146492 A1 7/2004 Hall et al.
2004/0150532 A1 8/2004 Hall et al.
2004/0164833 A1 8/2004 Hall et al.
2004/0164838 A1 8/2004 Hall et al.
2004/0216847 A1 11/2004 Hall et al.
2004/0244916 A1 12/2004 Hall et al.
2004/0244964 A1 12/2004 Hall et al.
2004/0246142 A1 12/2004 Hall et al.
2005/0001735 A1 1/2005 Hall et al.
2005/0001738 A1 1/2005 Hall et al.
2005/0035675 A1 2/2005 Hall et al.
2005/0035874 A1 2/2005 Hall et al.
2005/0035876 A1 2/2005 Hall et al.
2005/0036507 A1 2/2005 Hall et al.
2005/0039912 A1 2/2005 Hall et al.
2005/0045339 A1 3/2005 Hall et al.
2005/0046586 A1 3/2005 Hall et al.
2005/0046590 A1 3/2005 Hall et al.
2005/0067159 A1 3/2005 Hall et al.
2005/0070144 A1 3/2005 Hall et al.
2005/0082092 A1 4/2005 Hall et al.
2005/0092499 A1 5/2005 Hall et al.
2005/0093298 A1 5/2005 Hall et al.
2005/0095827 A1 5/2005 Hall et al.
2005/0115717 A1 6/2005 Hall et al.
2005/0145406 A1 7/2005 Hall et al.
2005/0150653 A1 7/2005 Hall et al.
2005/0161215 A1 7/2005 Hall et al.
2005/0173028 A1 8/2005 Hall et al.
2005/0212630 A1 9/2005 Hall et al.
2005/0236160 A1 10/2005 Hall et al.

* cited by examiner

STAB GUIDE

BACKGROUND OF THE INVENTION

The present invention relates to the field of making up tool strings, particularly tool strings used for oil and gas exploration. When making up drill strings, tool string components such as a swivel or kelly may be detached and reattached to and from the drill string. Such swivels may be data swivels as disclosed in U.S. Publication Nos. US 2004-0113808 A1 and US 2005-0046586 A1. In the process of reattachment, the swivel may collide with the top-most component of the drill string. Such collisions may damage the swivel or other components added to the drill string. In the prior art, several references disclose methods for making up a tool string.

U.S. Pat. No. 6,834,892, which is herein incorporated by reference for all that it discloses, discloses a self-aligning coupling for mating a pair of axially arranged first and second flanged fittings.

U.S. Pat. No. 4,295,527, which is herein incorporated by reference for all that it discloses, discloses a casing clamp and guide arrangement to permit ease of centering and securing of the next section of pipe casing to a downhole string comprising an elongated stable member having clamp means at either end with one clamp adapted to engage the top of the uppermost downhole pipe casing and the other clamp adapted to clamp and stabilize the next pipe casing section into coaxial alignment for threadable connection therewith.

U.S. Pat. No. 6,360,633, which is herein incorporated by reference for all that it discloses, discloses an apparatus for aligning a first tubular and a second tubular, in certain aspects, the first tubular extending through a power tong and the second tubular extending through a backup tong, the apparatus including positioning apparatus for guiding the power tong with respect to the backup tong and for maintaining said power tong and said backup tong in a certain juxtaposition during a tubular stabbing operation, the positioning apparatus including a plurality of spaced-apart locating rods projecting from one of said power tong and said backup tong and a plurality of spaced-apart blocks on the other of said power tong and said backup tong, and each block having a recess shaped to receive an end of one of the plurality of spaced-apart locating rods.

U.S. Pat. No. 3,447,829, which is herein incorporated by reference for all that it discloses, discloses a tool for handling drill rod having a reduced diameter portion near one end. The tool includes a connecting bar having a pilot member at one end which fits into the upper, open end of the drill rod. A lifting fork is at the other end of the connecting bar and fits into the reduced diameter portion of the drill rod to support the drill rod in a vertical position. A positioning member is located along the connection bar between the lifting fork and the pilot member.

BRIEF SUMMARY OF THE INVENTION

The present invention relates to tool string stab guides for axially aligning tool string components. The stab guide has a body with an axial length along a longitudinal axis with first and second sections. The stab guide may be formed of a material selected from the group consisting of metal, alloy, plastic, fiberglass, wood, elastomer, ceramic, and combinations thereof. The first section of the body is adapted for removable attachment within a diameter of a bore of a tool string component, and may be attached by at least one of the group consisting of threads, welds, compression, machine press, adhesives, hangers, and combinations thereof. The first section of the stab guide may further have a passage or multiple passages for fluid flow. The second section of the body has a centering element with a flow channel for fluid passage and may be replaceable and/or have a replaceable tip. A ratio between the axial length and the diameter of the bore of the tool string component may be at least 2:1.

The stab guide may also have a filter element which may be selected from the group consisting of perforated surfaces, bars, bristles, and screens. The filtering element may be attached within, above, or below the flow channel of the stab guide. The filter element may be detachable.

It should be noted that the term "perforated surface" refers to a surface comprising a plurality of orifices of circular shape, rectangular shape, conical shape or other shapes.

The flow channel may have a passage or multiple passages through which drilling fluids may pass through the stab guide. It should be noted that the term "passage" refers to a path, channel, or duct through, over, or along which something may pass.

The centering element may have a series of diminishing diameters. The series of diminishing diameters may have a beginning diameter equal to the diameter of the bore of the tool string component. In alternate embodiments the series of diminishing diameters may have a beginning diameter less than an inside diameter of a bore of an adjoining tool string component.

In other aspects of the invention the centering element may have a plurality of rods projecting radially from the longitudinal axis. When making up a tool joint, a first tool string component may be misaligned with a second tool string component and the rods projecting radially may come into contact with a primary shoulder of the second tool string component centering the first tool string component over the second tool string component. The rods projecting radially may also act as a filter.

The stab guide may have a protective coating such as a metal carbide coating. In one embodiment the stab guide may have a first plate centered along the longitudinal axis. The stab guide may further have a second plate intersecting with the first plate at the longitudinal axis, wherein the plates may subdivide the bore of the tool string component into passages within which there may be a reinforcing element. The reinforcing element may have a filter element.

A system for aligning tool string components with a stab guide. The stab guide having a body with an axial length along a longitudinal axis having first and second sections. The body may be formed of a material selected from the group consisting of metal, alloy, plastic, fiberglass, wood, elastomer, ceramic, and combinations thereof. The first section of the body is adapted for removable attachment within a diameter of a bore of a first tool string component, and may be attached by at least one of the group consisting of threads, welds, compression, machine press, adhesives, hangers, and combinations thereof. The second section of the body has a centering element with a flow channel for fluid passage and may be replaceable and/or have a replaceable tip.

Wherein, when the stab guide is attached within the bore of the first tool string component the centering element axially aligns the first tool string component within the second tool string component before the first tool string component engages the second tool string component. The centering element may be selected from the group consisting of a series of diminishing diameters, a plurality of radially extending rods from the longitudinal axis, and long tubules or rods. The stab guide may further have a filter element, and a protective coating

DETAILED DESCRIPTION OF THE INVENTION AND THE PREFERRED EMBODIMENTS

Figure 1:
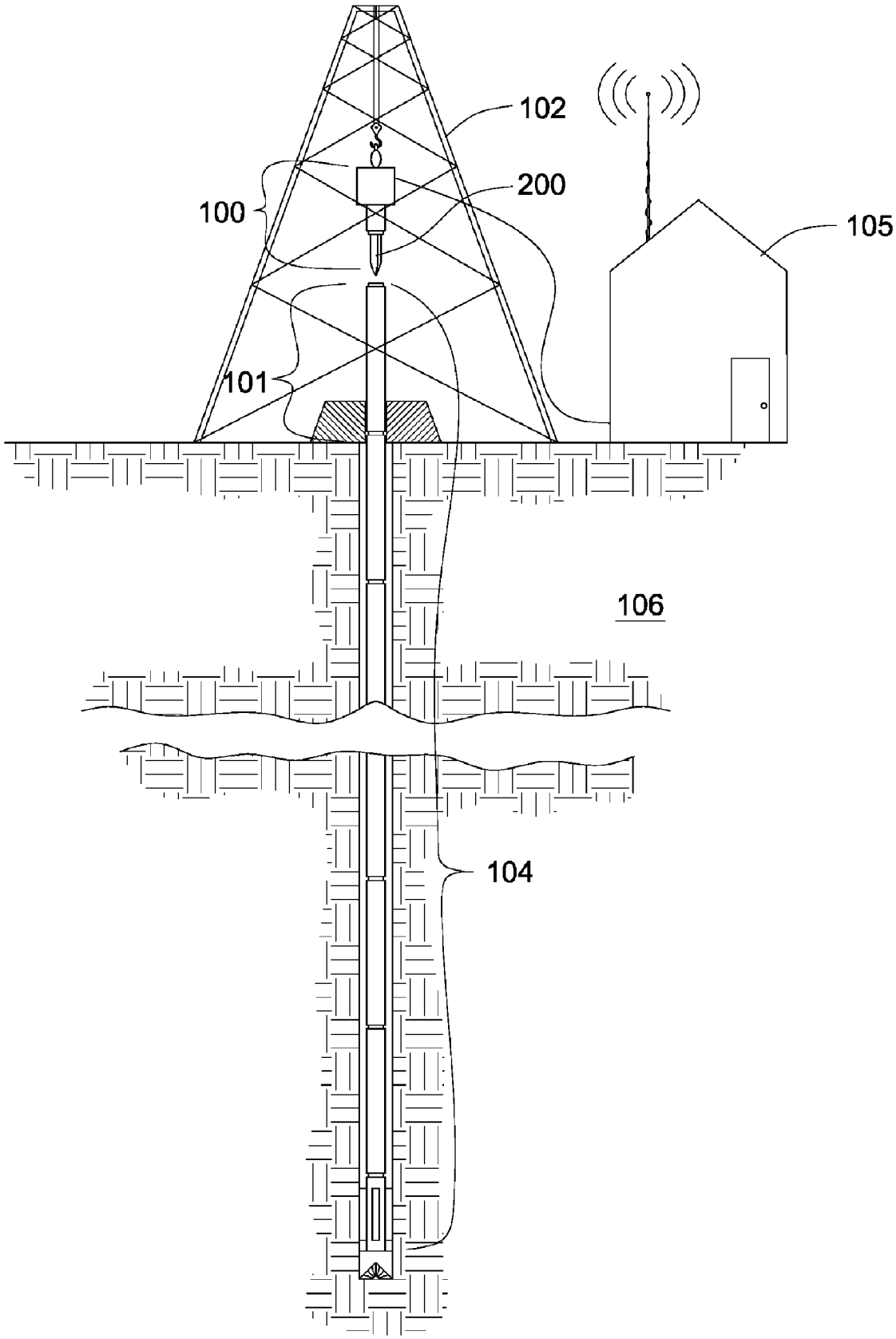
FIG. 1 is a cross-sectional diagram of a drilling operation including a tool string suspended within the earth.

Referring to the drawings, FIG. 1 is a cross-sectional diagram of a drilling operation including a tool string 104 suspended within the earth 106. A derrick 102 suspends a first tool string component 100 comprising a stab guide 200 during the drilling operation. The first tool string component 100 is being attached to a second tool string component 101. The first tool string component 100 may be a swivel that acts as a data interface between a data transmission system within the rotatable tool string 104 and stationary surface equipment 105, such as a computer. The first tool string component 100 may be a kelly or a saver sub. Further, the first tool string component 100 may be a drill pipe temporarily located near the surface of the earth 106, such as when making up a drill string, which may advance into the drilling bore hole as the drill string advances into the earth. The first tool string component 100 may comprise a wireless transceiver adapted to pass information between a data transmission system in the tool string 104 and the surface equipment 105. A top-hole drive adapted to turn the tool string 104 may comprise a wireless transceiver that may also communicate with the wireless transceiver of the first tool string component 100. The wireless transceiver of the top-hole drive may be in communication with the surface equipment 105.

Figure 2:
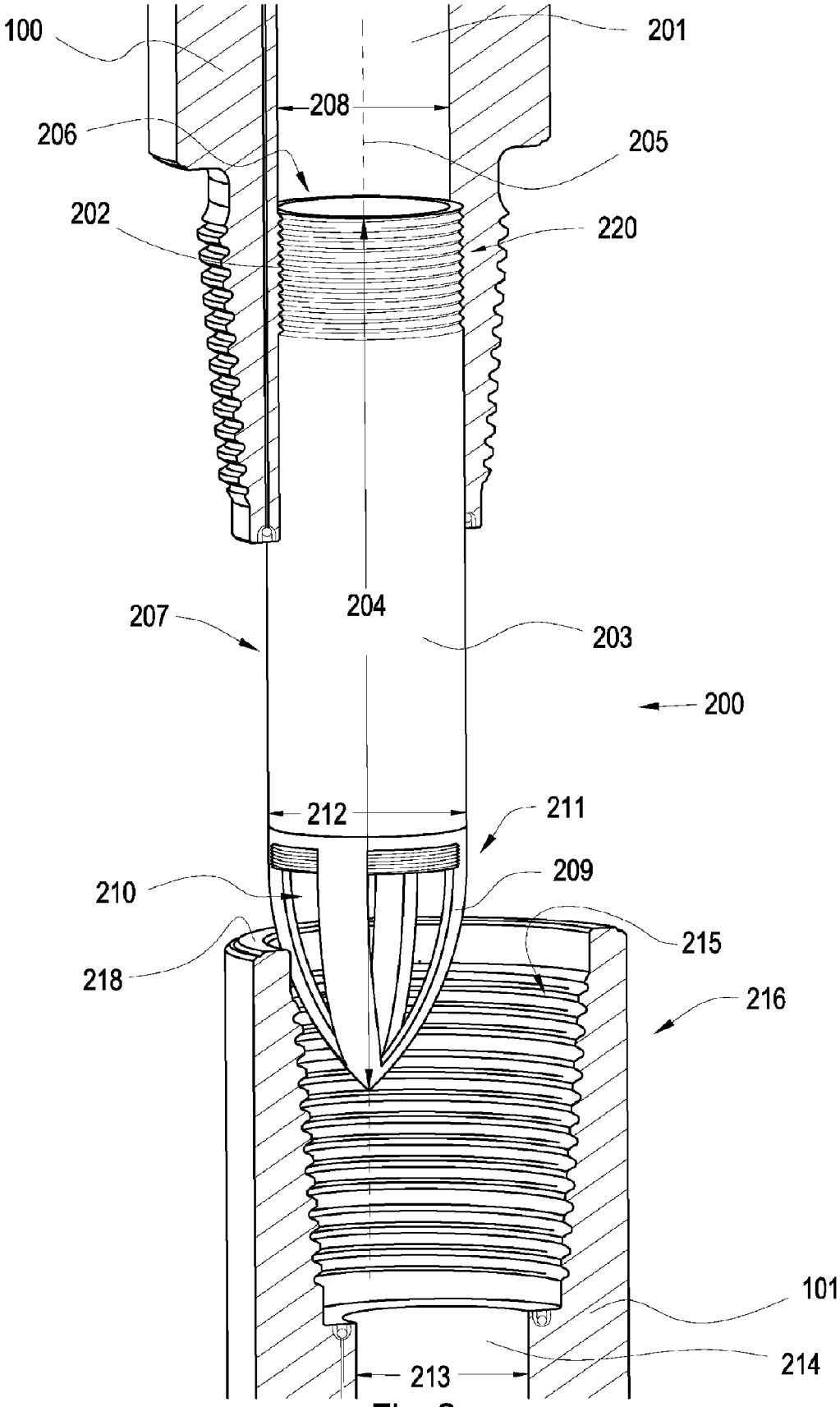
FIG. 2 is perspective cross-sectional diagram of a first tool string component and a second tool string component with a stab guide attached within a bore of the first tool string component.

FIG. 2 is a perspective cross-sectional diagrams of the first tool string component 100 and the second tool string component 101 with a stab guide 200 attached within a bore 201 of the first tool string component 100 by threads 202. The stab guide 200 comprises a body 203 having an axial length 204 along a longitudinal axis 205 comprising first and second sections 206, 207. The first section 206 of the body 203 is adapted for removable attachment within a diameter 208 of the bore 201 of the first tool string component 100. The second section 207 of the body 203 comprising a centering element 209 with a flow channel 210 for the passage of fluid. Wherein a ratio of the axial length 204 to the diameter 208 is at least 2:1.

The first section 206 of the stab guide 200 is preferably attached within the bore 201 of the first tool string component 100 by an attachment 220 that allows for easy replacement of the stab guide 200. The stab guide 200 may be attached within the bore 201 of the first tool string component 100 by threads, welds, compression, bolts, machine press, adhesives, hangers, or combinations thereof.

The second section 207 may have a centering element 209 comprising a series of diminishing diameters 211. The series of diminishing diameters 211 may have a beginning diameter 212 from which they start to diminish which may be equal to the diameter 208 of the bore 201 of the first tool string component 100. In other embodiments the beginning diameter 212 may be equal to the inner diameter 213 of the bore 214 of the second tool string component 101.

The second section 207 of the stab guide 200 may be replaceable. The second section 207 may connect to the stab guide 200 by threads, welds, compression, bolts, machine press, adhesives, hangers, or combinations thereof. The second section 207 may be composed of a material selected from the group consisting of steel, stainless steel, brass, copper, aluminum, plastics and polymers. The second section 207 may be composed of a material that is softer than the material the second tool string component 101 is composed of. This may prevent the second section 207 of the stab guide 200 from marring the threads 215 of the box end 216 of the second tool string component 101 when making up a joint.

Figure 3:
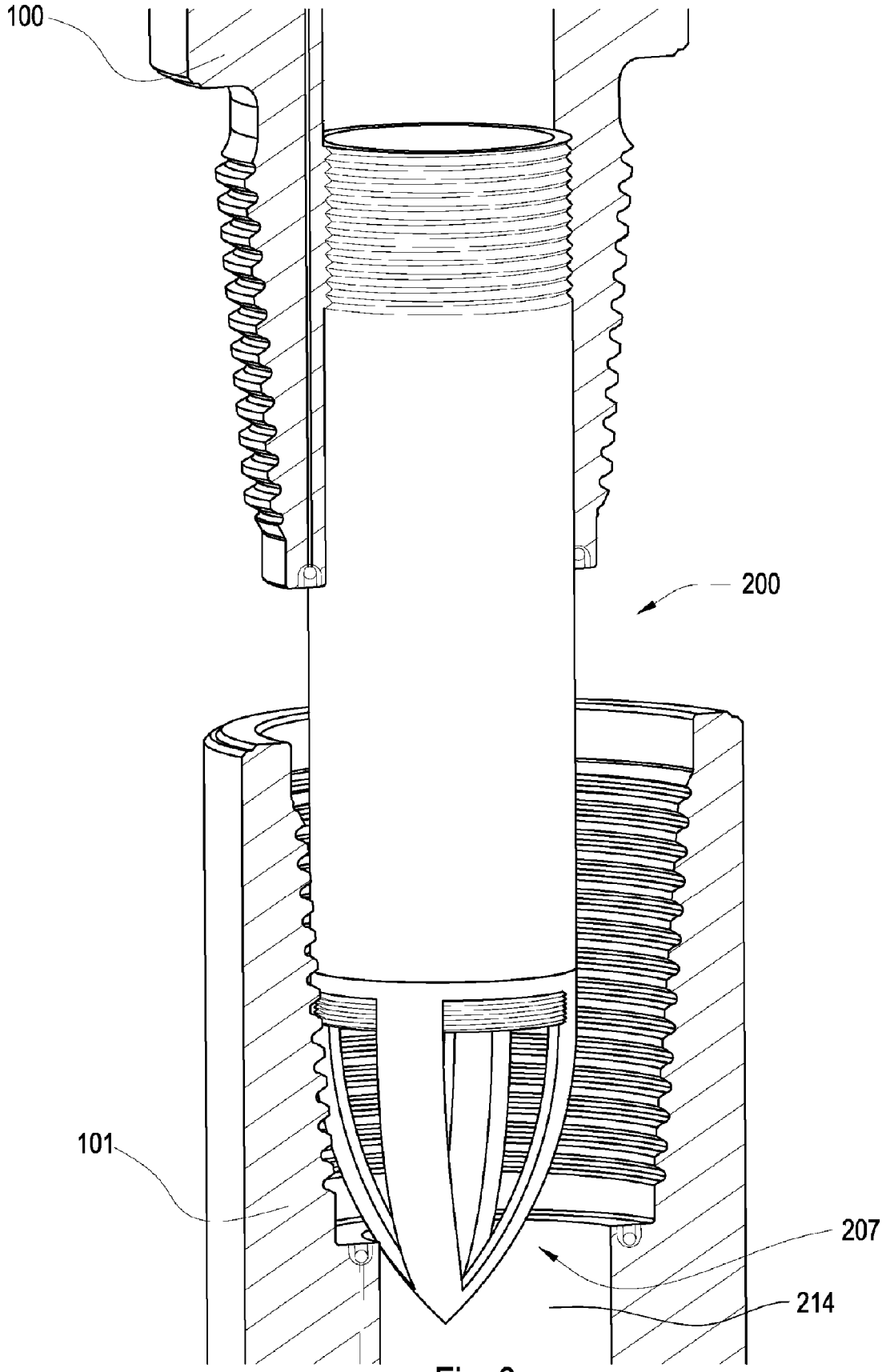
FIG. 3 is a perspective cross-sectional diagram of a second section of the stab guide slightly penetrating into the bore of the second tool string component.
Figure 4:
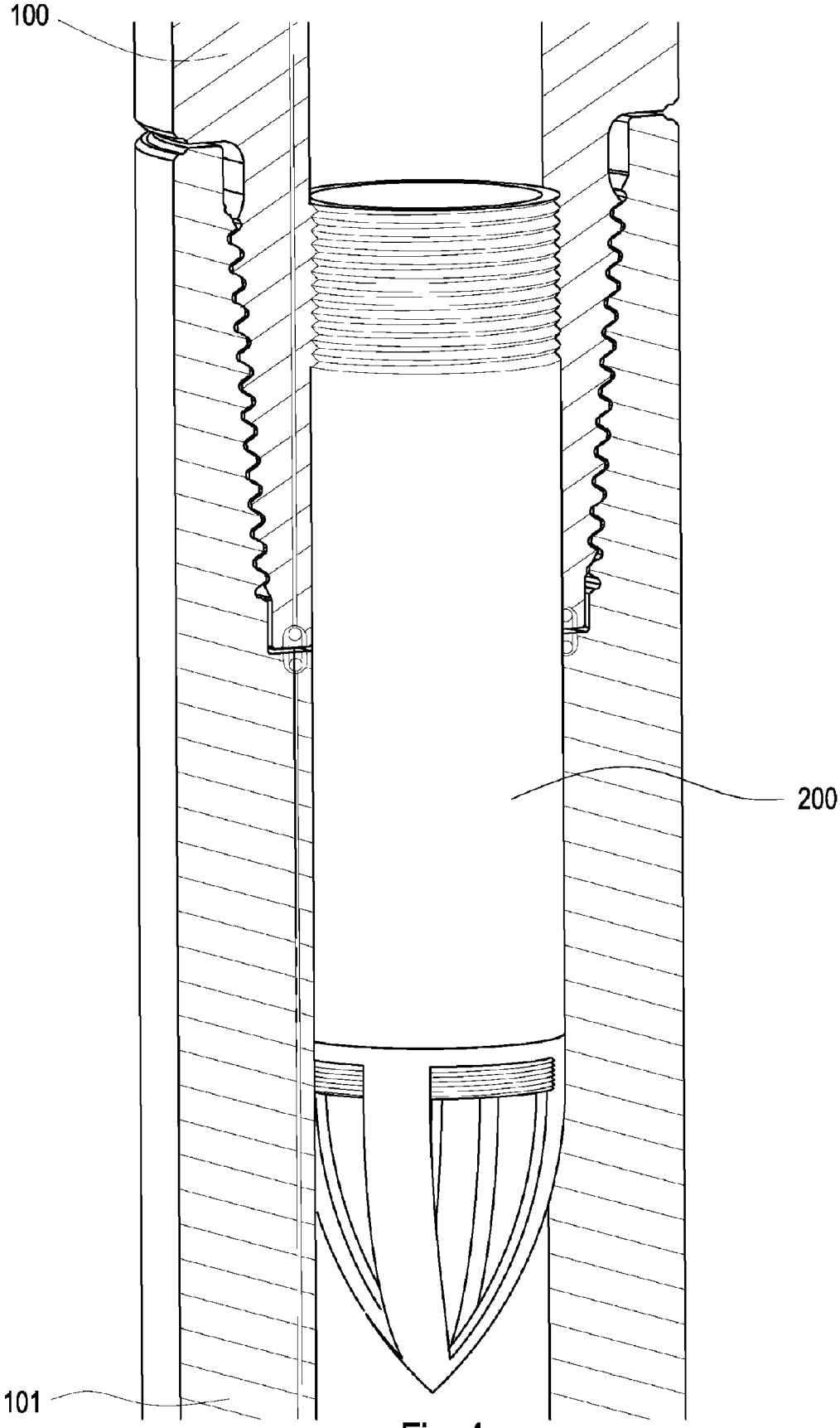
FIG. 4 is a perspective cross-sectional diagram of the final position of the stab guide after a joint has been made.

The second section 207 of the stab guide 200 may make contact with the primary shoulder 218 of the second tool string component 101. The contact may favor the movement of the first tool string component 100 such that it is more axially aligned with the second tool string component 101. FIG. 3 diagrams the second section 207 of the stab guide 200 slightly penetrating into the bore 214 of the second tool string component 101 further centering the first tool string component 100 over the second tool string component 101. FIG. 4 diagrams the final position of the stab guide 200 after a joint has been made.

Figure 5:
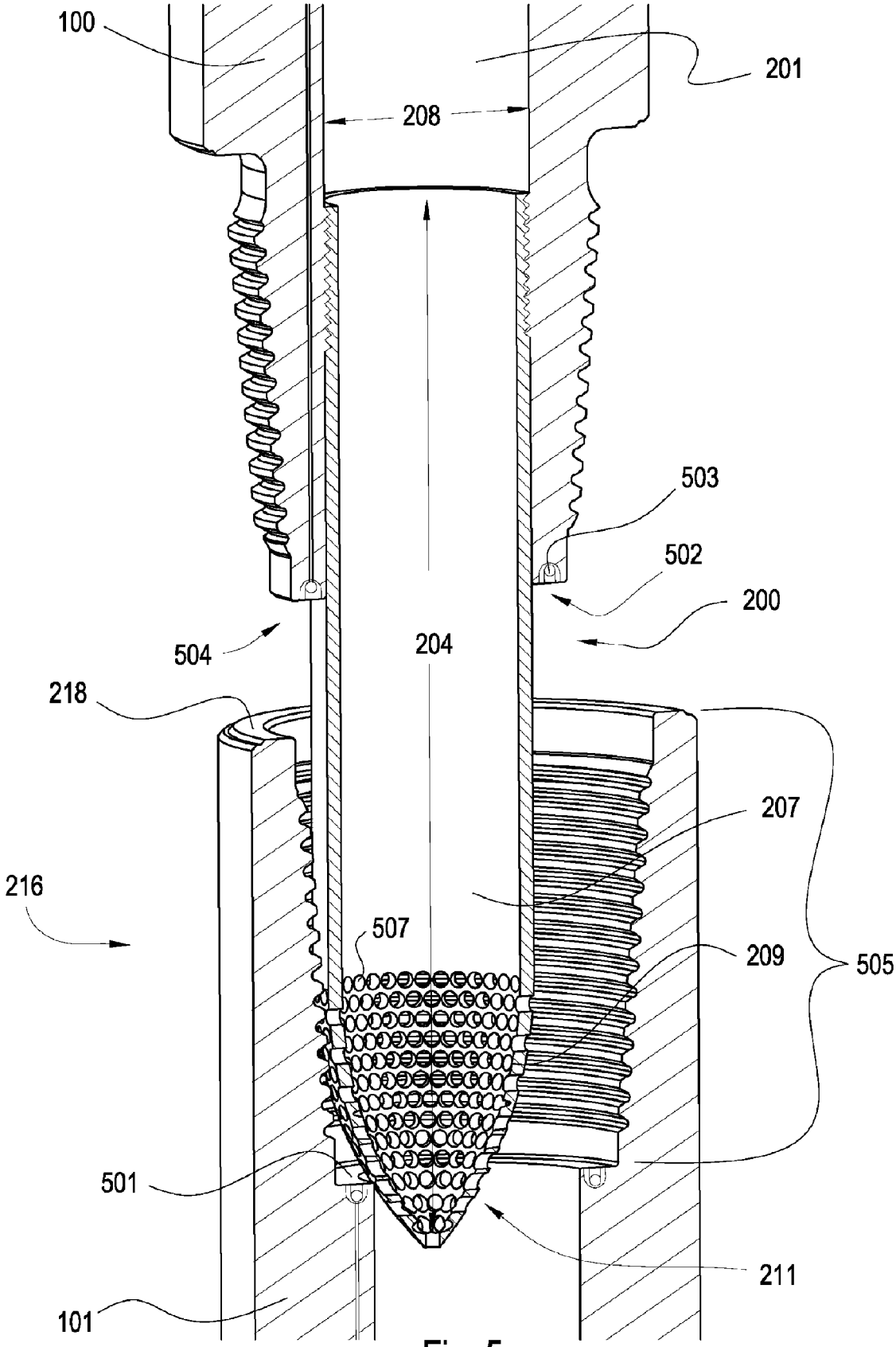
FIG. 5 is a perspective cross-sectional diagram of a first tool string component, a second tool string component and an alternate embodiment of a stab guide.

Referring now to FIG. 5, When making up a joint between the first tool string component 100 and the second tool string component 101, if a primary shoulder 218 and/or a secondary shoulder 501 of the second tool string component 101 comes into contact with the centering element 209 of the second section 207, the series of diminishing diameters 211 may center the first tool string component 100 over the second tool string component 101, such that the a secondary shoulder 502 of the first tool string component 100 may not make contact with the primary shoulder 218 of the second tool string component 101. This may prevent damage to elements 503 on the secondary shoulder 502 used in a data transmission system from hitting or striking the primary shoulder 218.

Alternately, the transmission system may contain elements in the primary shoulder 218 of the second tool string component 101 as disclosed in U.S. Pat. No. 6,670,880, which is herein incorporated by reference for all it discloses. In such embodiments, the stab guide 200 may still align the first tool string component 100 such that the primary shoulder 218 of the second tool string component 101 and the secondary shoulder 502 of the first tool string component 100 do not make contact when making up a joint. This may prevent data transmission elements 503 in the primary shoulder 218 of the second tool string component 101 from hitting or striking the secondary shoulder 502 of the first tool string component 100 and damaging the transmission system.

To ensure proper alignment, the stab guide 200 may comprise a sufficient axial length 204 for axially aligning the second section 207 within the second tool string component 101 before the first tool string component 100 engages the second tool string component 101. A "sufficient axial length" 204 is a length whereby the stab guide 200 aligns the first tool string component 100 with the second tool string component 101 enough to prevent contact between the distal most part 504 of the first tool string component 100 and the primary shoulder 218 of the second tool string component 101 when making up a joint. The sufficient axial length 204 may be equal to or greater than two times the diameter 208 of the bore 201 of the first tool string component 100. In other embodiments the sufficient axial length 204 may be equal to or greater than the box length 505 of the second tool string component 101. The "box length" 505 of the second tool string component 101 is the distance from the primary shoulder 218 of the box end 216 to the secondary shoulder 501 of the box end 216.

The second section 207 may further comprise a generally cylindrical shape, a generally rectangular shape, a generally triangular shape or a generally octahedral shape. The second section 207 of the stab guide 200 may comprise perforations 507 to allow the flow of drilling mud through the stab guide 200. The perforations 507 may further act as a filter.

Figure 6:
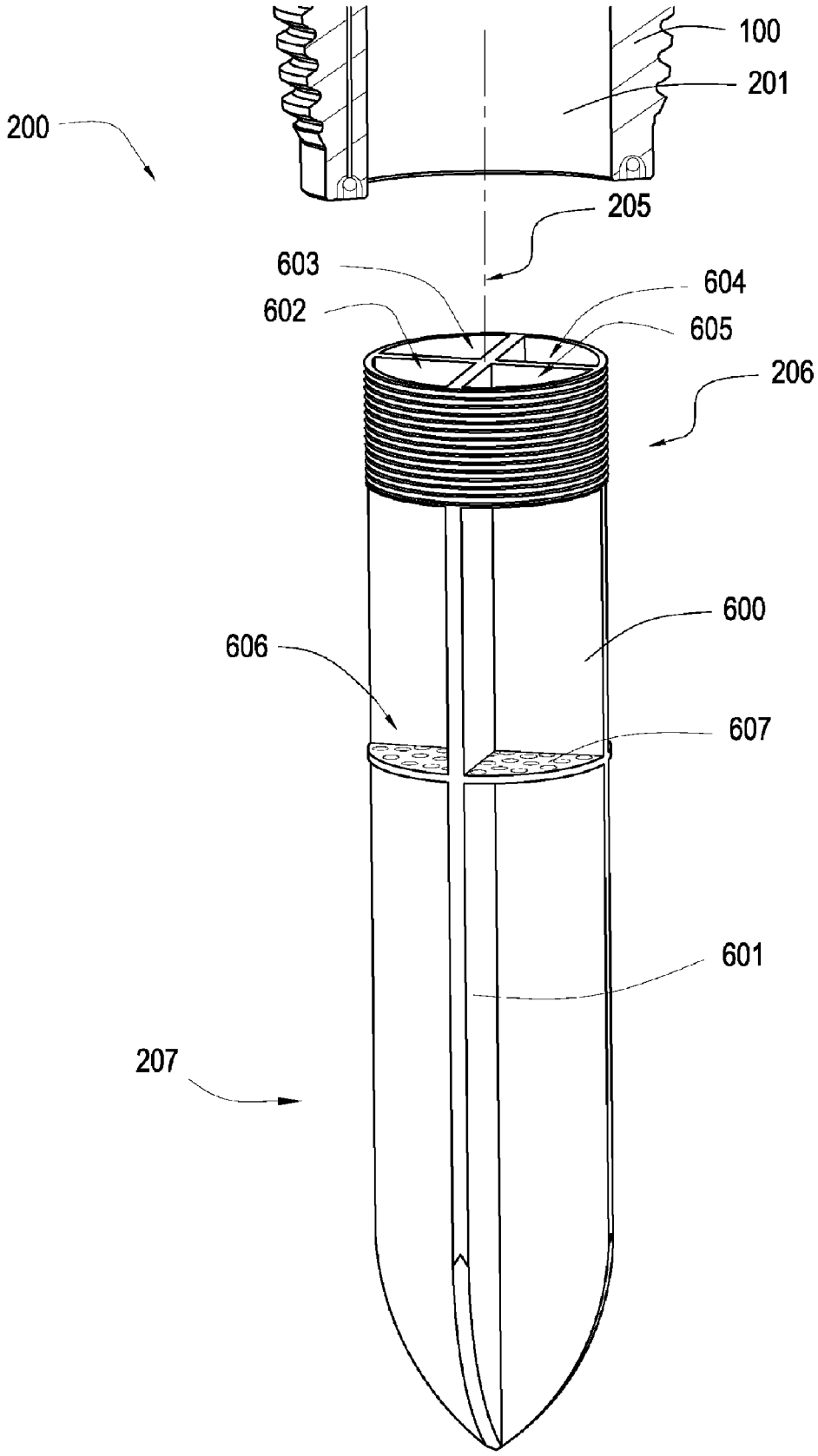
FIG. 6 is a perspective diagram of an alternate embodiment of a stab guide with plates.

FIG. 6 shows an embodiment of the stab guide 200 comprising a first plate 600 centered along the longitudinal axis 205. The stab guide 200 may comprise a second plate 601 intersecting with the first plate 600 at the longitudinal axis 205, wherein the plates may subdivide the bore 201 of the first tool string component 100 into passages 602, 603, 604, 605. The stab guide 200 may comprise a third plate (not shown) intersecting the longitudinal axis 205 with the first and second plates 600, 601. The guide may comprise more than three intersecting plates (not shown).

Figure 7:
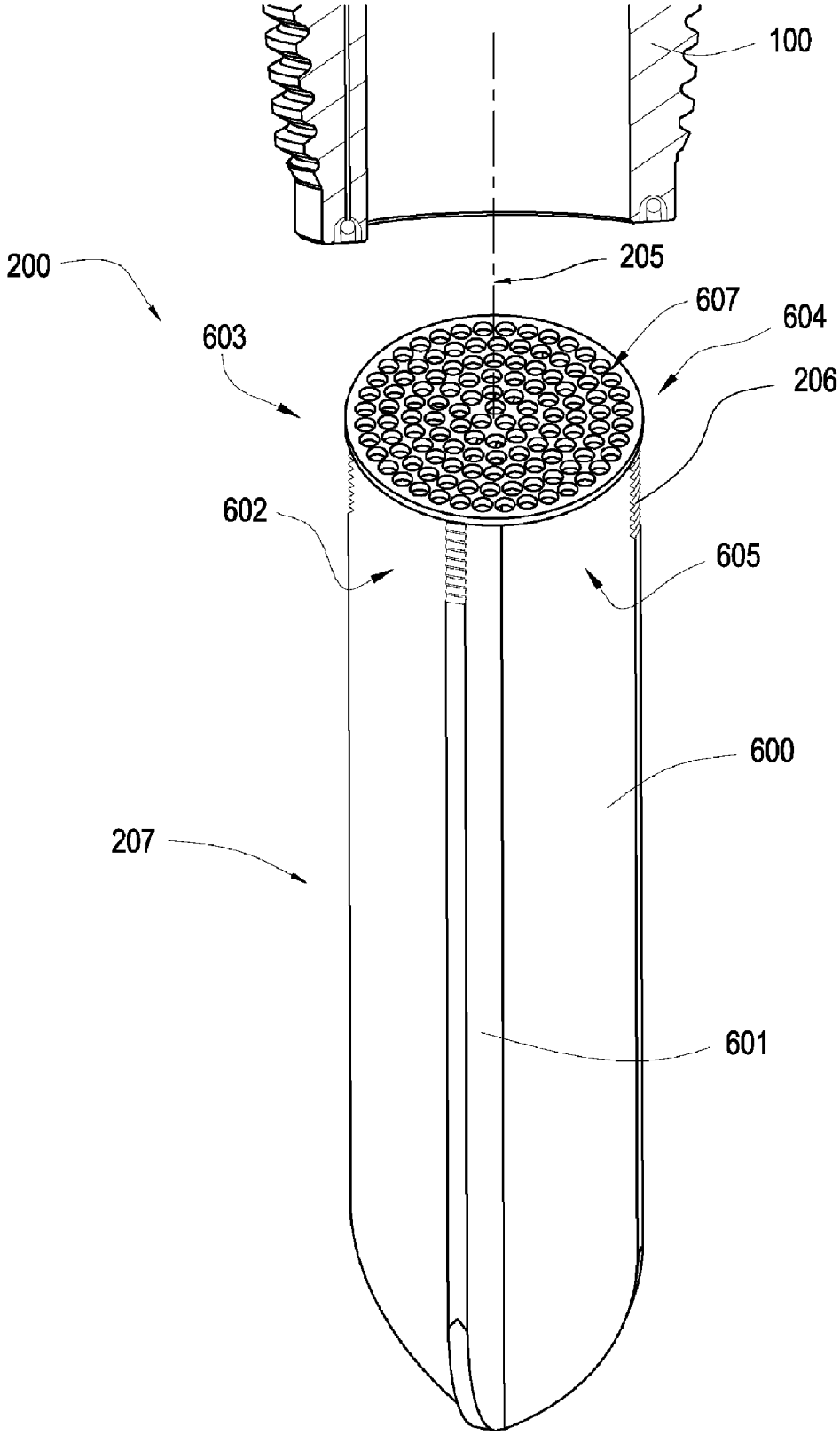
FIG. 7 is a perspective diagram of one embodiment of the stab guide with a filter element.
Figure 8:
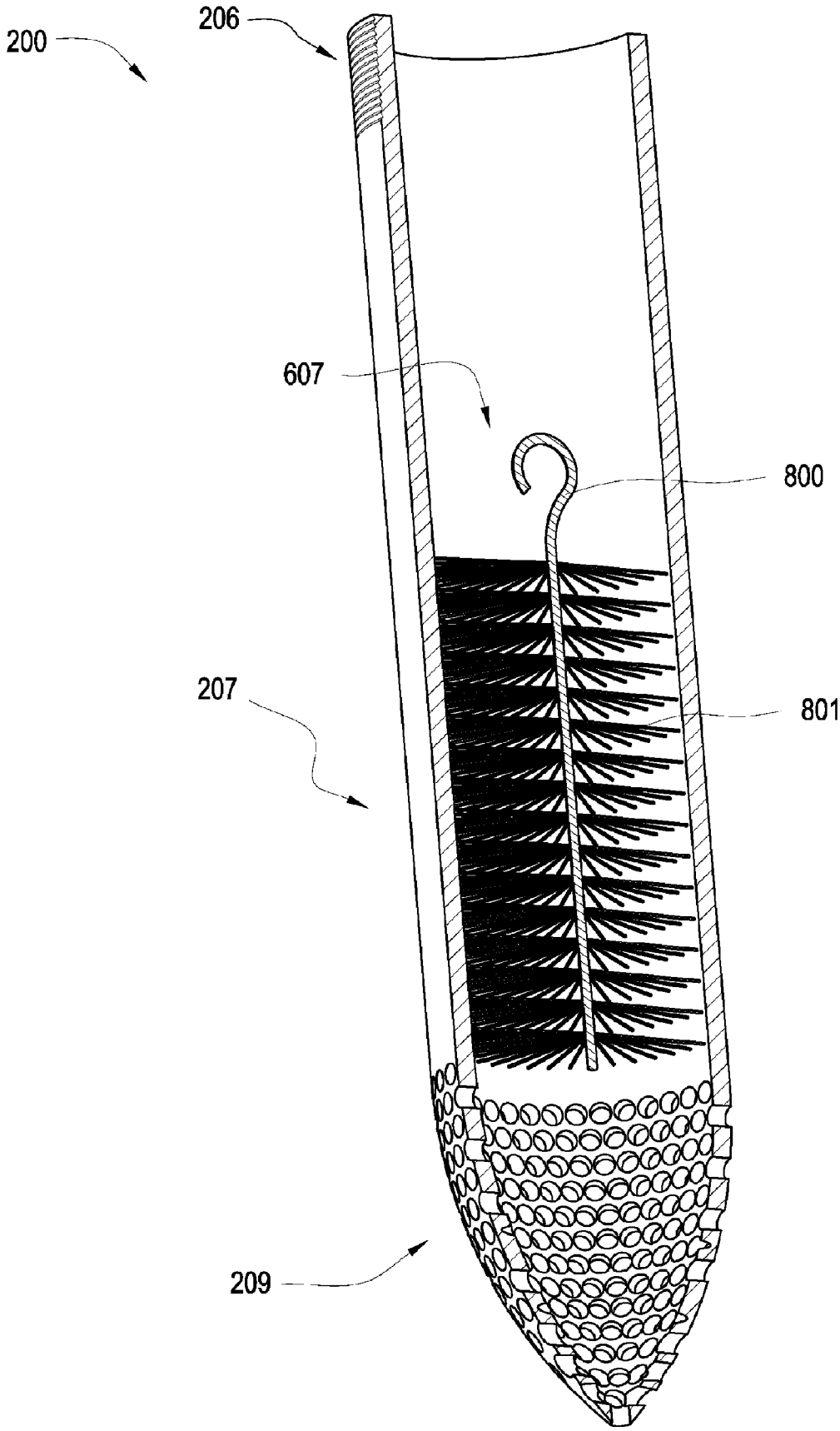
FIG. 8 is a perspective cross-sectional diagram one embodiment of the stab guide with the filter element resting within the second section.

The stab guide 200 may comprise a reinforcing element 606 which may comprise a filter element 607. The reinforcing element 606 may be attached within a passage, or multiple passages 602, 603, 604, 605. The filter element 607 may be attached adjacent the passages 602, 603, 604, 605 on the first section 206 as in FIG. 7. Alternately, the filter element 607 may be attached or rest within the second section 207 as shown in FIGS. 6, 8. The filter element 607 may be detachable. Any of the other components of the stab guide 200 including the first section 206 and the second section 207 may act as a filter. The filter element 607 may be attached to the guide 200 by threads, welds, compression, machine press, bolts, adhesives, clips, or hangers.

The filter element 607 may be selected from the group consisting of perforated surfaces, rods, wires, threads, bristles, filaments, and screens. FIG. 8 shows an alternate embodiment of a filter element 607 located within the second section 207 of the stab guide 200 comprising, a central stem 800 with a plurality of radially extending bristles 801. As the drilling fluid flows through the guide 200, the plurality of radially extending bristles 801 may block large rocks and debris from passing through. The filter element 607 with radially extending bristles 801 may also be easy to replace.

Preferably the stab guide 200 is composed of a metal or alloy. A metal stab guide 200 may be able to withstand the harsh drilling fluids and severe drilling environment. The stab guide 200 may also be composed of a material selected from the group consisting of plastics, fiberglass, woods, elastomers, ceramics, and combinations thereof. Further, the stab guide 200 may comprise a protective coating against weakening, loss, corrosion, galvanic corrosion, or other forms of destruction of the stab guide 200 material. The coating may be selected from the group consisting of nickel, cobalt, gold, silver, tungsten, phosphorus, copper, aluminum, mixtures thereof, combinations thereof, and alloys thereof. The coating may coat the plates 600, 601, first section 206, second section 207, and the filter element 607.

FIGS. 5, 8 diagram an embodiment of the stab guide 200 with hollow first and second sections 206, 207, and a perforated centering element 209. An advantage of having hollow first and second sections 206, 207 is that drilling fluids are able to flow through the drill string with little obstruction from the stab guide 200. Alternately, the first and second sections 206, 207 may have a number of passages 602, 603, 604, 605 for the fluid to flow through, see FIG. 6. The passages 602, 603, 604, 605 may act as a filter.

Figure 9:
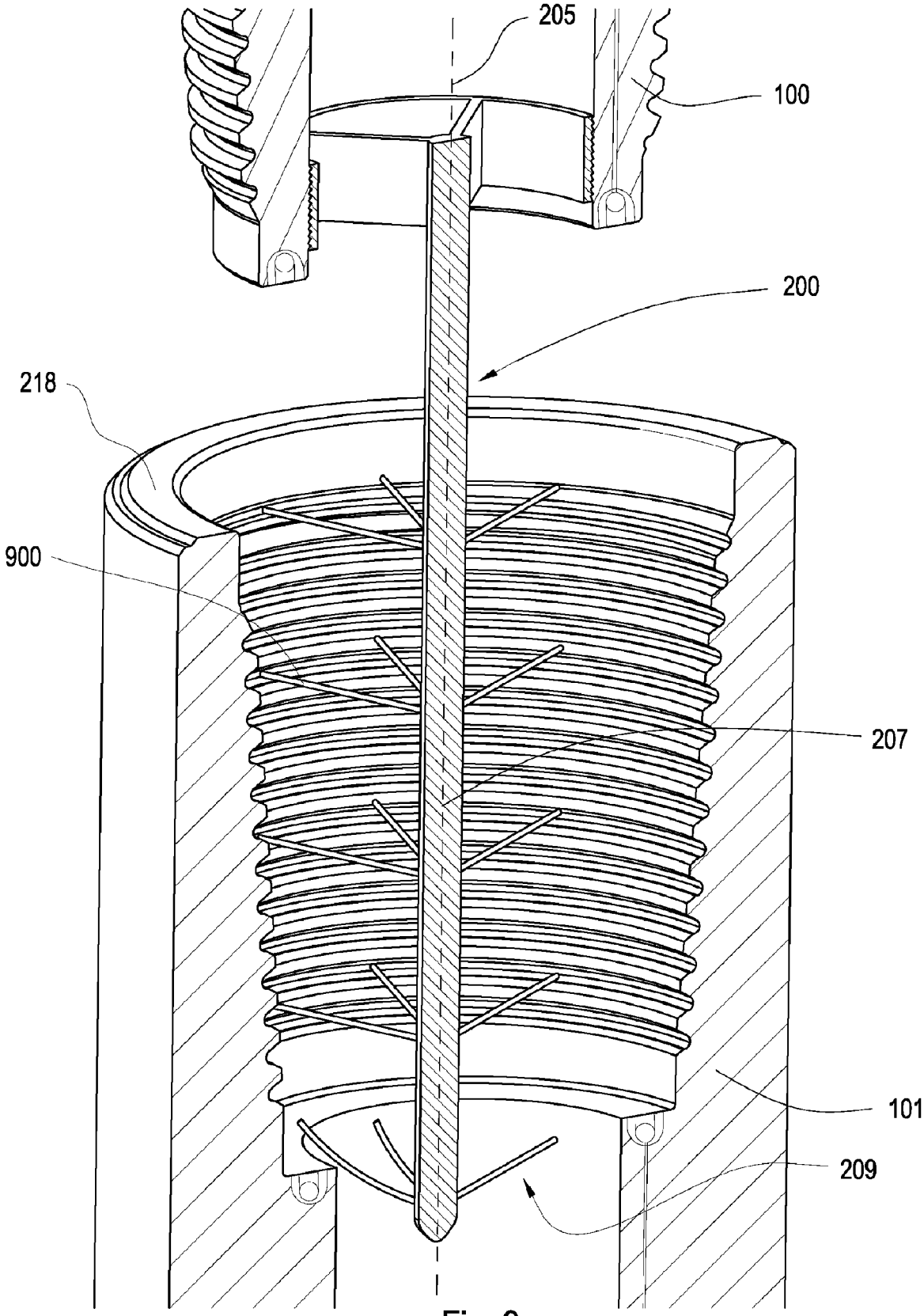
FIG. 9 is a perspective cross-sectional diagram of an embodiment of the stab guide having a centering element with a plurality of rods projecting radially from a longitudinal axis.

FIG. 9 shows an alternate embodiment of the stab guide 200 with the centering element 209 comprising a plurality of rods 900 projecting radially from the longitudinal axis 205. When making up a tool joint, the first tool string component 100 may be misaligned with the second tool string component 101, the radially projecting rods 900 may come in contact with the primary shoulder 218 of the second tool string component 101 causing the first tool string component 100 to center over the second tool string component 101. The radially extending rods 900 may also act as a filter.

Figure 10:
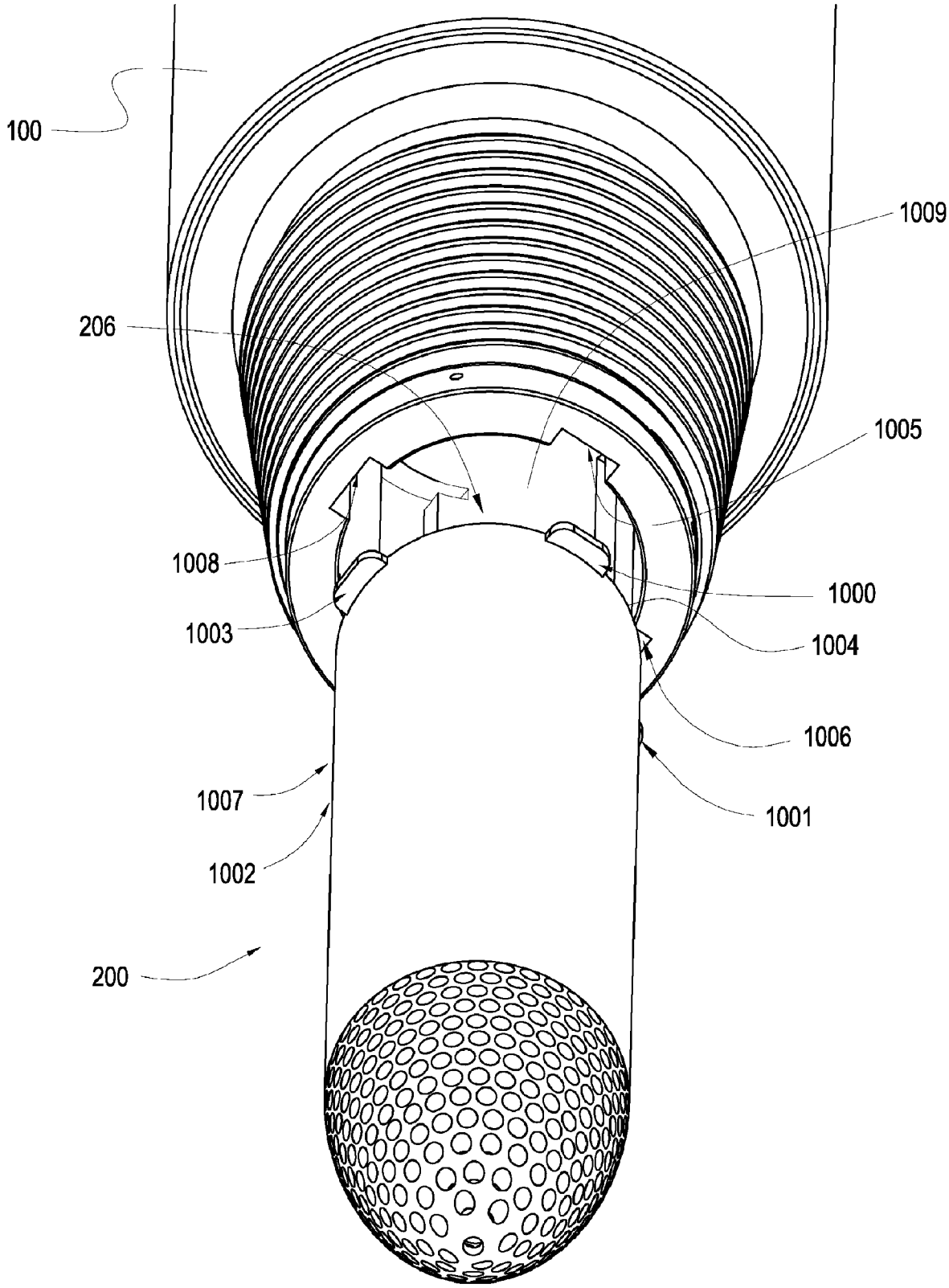
FIG. 10 is a perspective diagram of one embodiment of the stab guide with hangers spaced 90 degrees apart around a outer circumference of a first section of the stab guide.

FIG. 10 shows one embodiment of the stab guide 200 with hangers 1000, 1001, 1002, 1003 spaced 90 degrees apart from each other on the outer circumference 1004 of the first section 206 of the stab guide 200. FIG. 10 further shows the corresponding recesses 1005, 1006, 1007, 1008 for attachment on the bore wall 1009 of the first tool string component 100. The hangers 1000, 1001, 1002, 1003 may attach within a plurality of ridges on the bore wall 1009 of the first tool string component 100 (not shown). Alternatively, the recesses 1005, 1006, 1007, 1008 may be formed in a ring welded within the first tool string component 100 (not shown). The hanger type attachment may provide the advantage of quick attachment and detachment of the stab guide 200 from the first tool string component 100.

Figure 11:
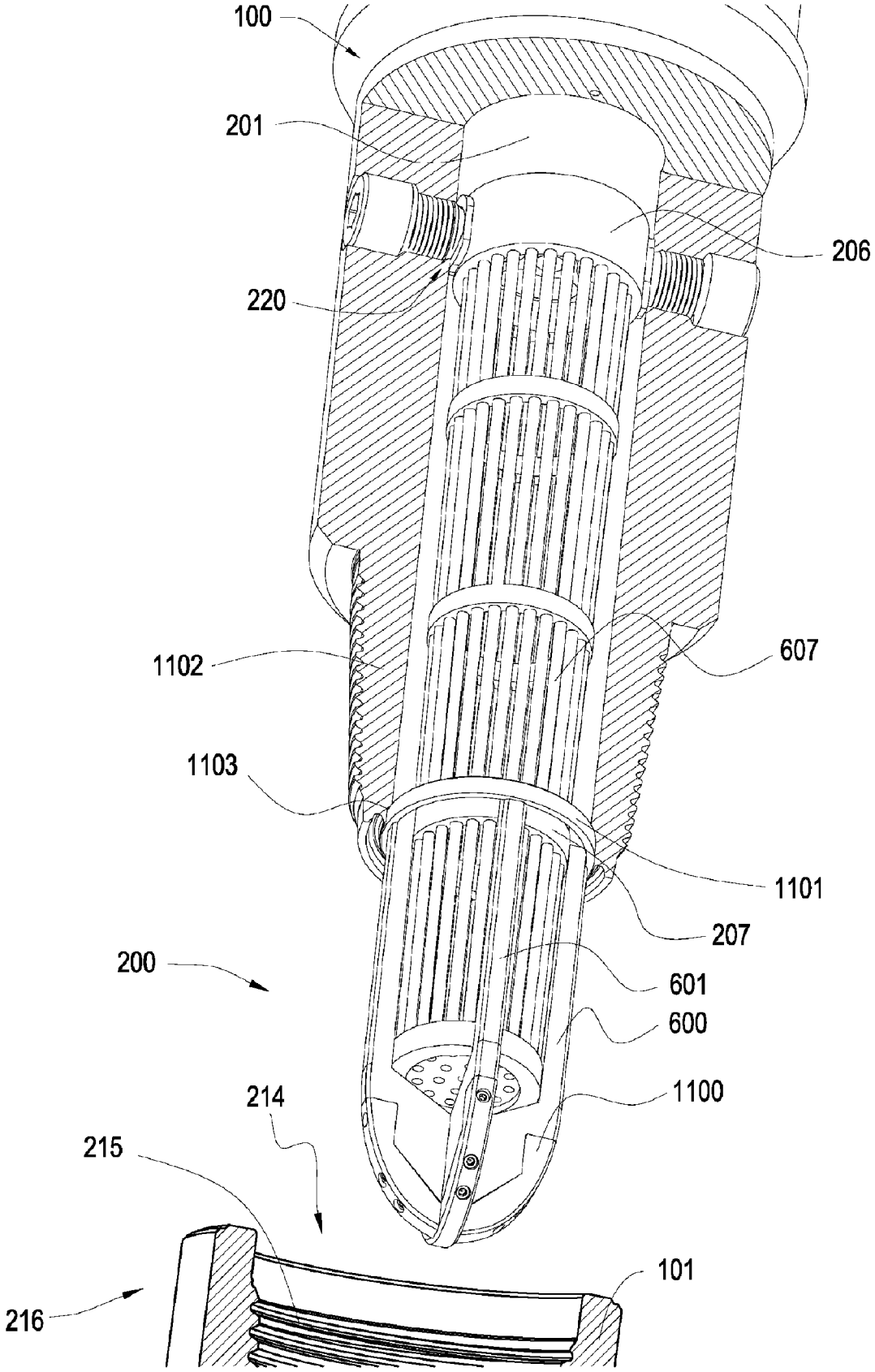
FIG. 11 is a perspective cross-sectional diagram of the preferred embodiment of the stab guide with the second section comprising a replaceable tip.

FIG. 11 is the preferred embodiment of the stab guide 200 with the second section 207 comprising a replaceable tip 1100. The replaceable tip 1100 may be composed of a material selected from the group consisting of steel, stainless steel, brass, copper, aluminum, plastics and polymers. Preferably the replaceable tip 1100 is composed of a material that is softer than the material the second tool string component 101 is composed of. This may prevent the second section 207 of the stab guide 200 from marring the threads 215 of the box end 216 of the second tool string component 101 when making up a joint.

Still referring to FIG. 11 wherein the first and second plates 600, 601 of the stab guide 200 extend along the contour of the filter element 607. In this embodiment the filter element 607 may give strength to the stab guide 200 as well as provide a large filtering area.

The stab guide 200 may further comprise a ring 1101 around the circumference of the second section 207. In this embodiment the pin end 1102 of the first tool string component 100 may comprise a recess 1103 on the bore 201 of the first tool string component 100. The ring 1101 may rest within the recess 1103 when the stab guide 200 is attached within the bore 201 of the first tool string component 100. This may prevent the stab guide 200 from falling down the bore 214 of the joining second tool string component 101. It may also take away from the force applied to the attachment 220 of the first section 206 when the stab guide 200 makes contact with the second tool string component 101.

Figure 12:
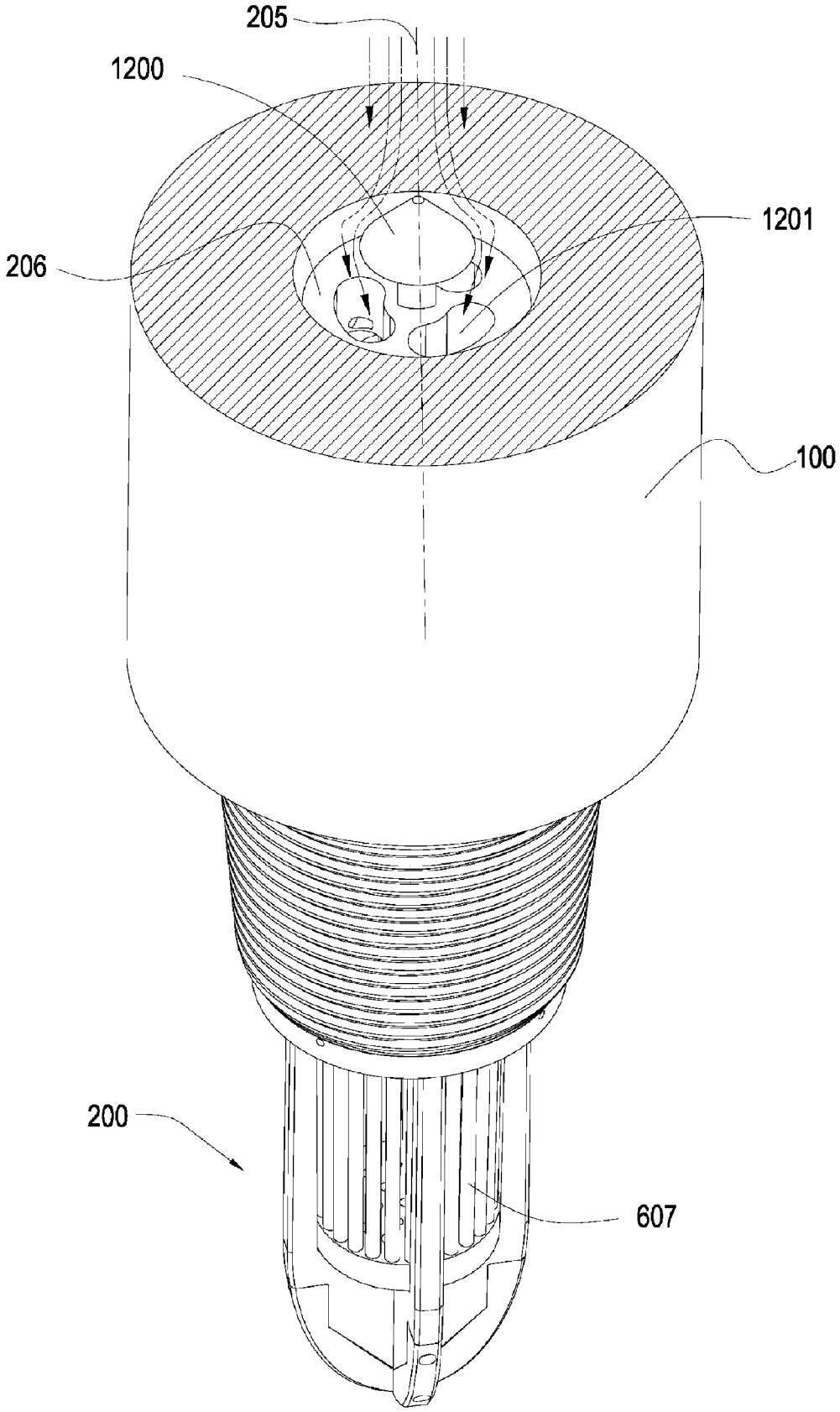
FIG. 12 is a perspective cross-sectional diagram of one embodiment of the stab guide with a debris deflector attached to the first section of the stab guide along the longitudinal axis.

FIG. 12 is an embodiment of the stab guide 200 with a debris deflector 1200 attached to the first section 206 of the stab guide 200 along the longitudinal axis 205. When a rock or other form of debris (not shown) comes into contact with the debris deflector 1200 the debris may be deflected. This may prevent debris traveling in the drilling mud from damaging the filter element 607 on the stab guide 200 or blocking passage of the drilling mud through the entrance ports 1201 of the filter element 607.

Figure 13:
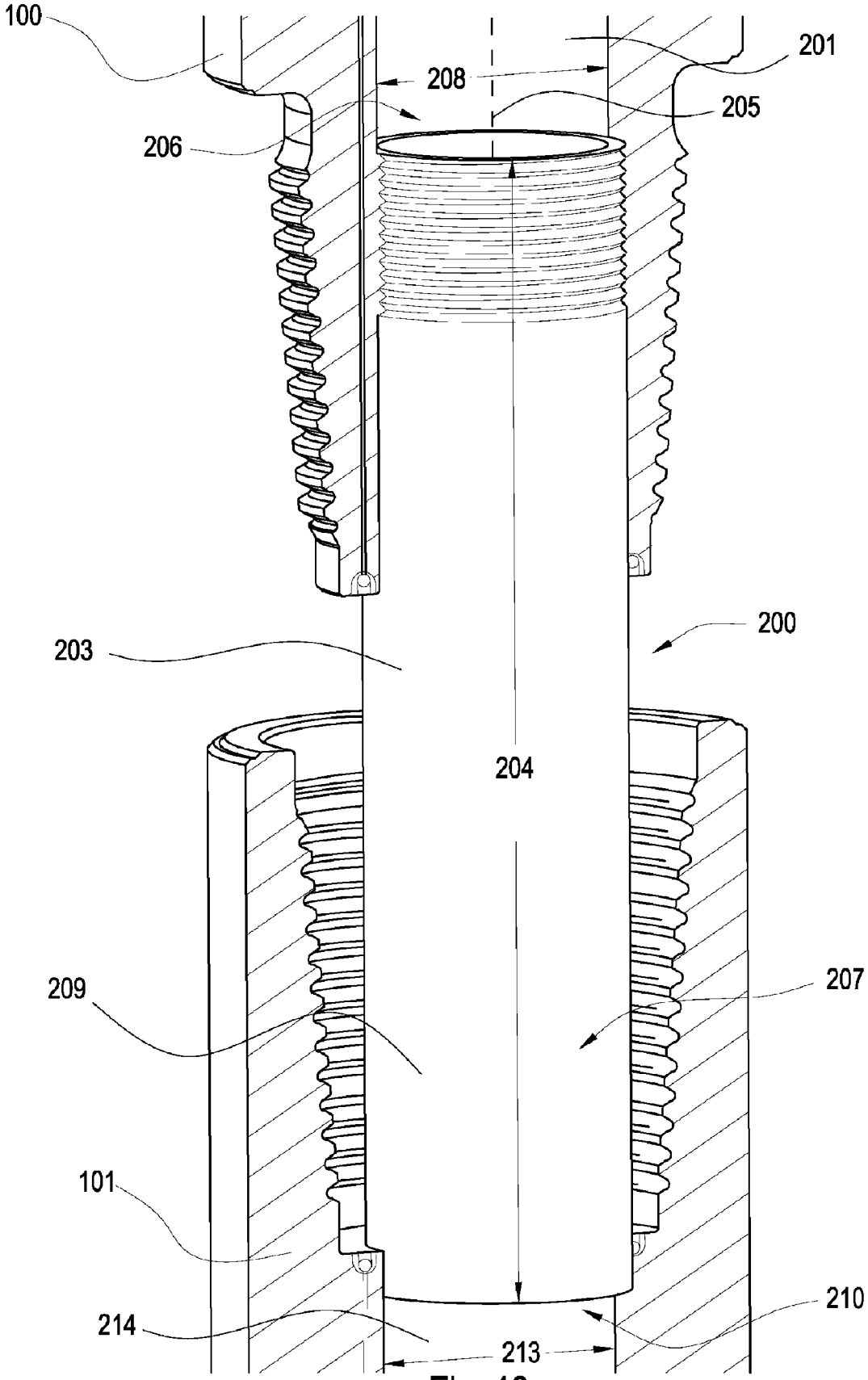
FIG. 13 is a perspective cross-sectional diagram of an alternate embodiment of the stab guide with a long tubule as the centering element.

Referring now to FIG. 13, a system for aligning tool string components 100, 101 comprising a body 203 having an axial length 204 along a longitudinal axis 205 comprising first and second sections 206, 207. The first section 206 of the body 203 is adapted for removable attachment within a diameter 208 of a bore 201 of the first tool string component 100. The second section 207 of the body 203 comprising a centering element 209 with a flow channel 210. Wherein, when the first section 206 is attached within the bore 201 of the first tool string component 100 the centering element 209 axially aligns the first tool string component 100 within a second tool string component 101 before the first tool string component 100 engages the second tool string component 101. The centering element 209 may be a long tubule.

Still referring to FIG. 13, the first section 206 of the body 203 may attached within the bore 201 of the first tool string component 100 by at least one of the group consisting of threads, welds, compression, machine press, adhesives, hangers, and combinations thereof. The body 203 may comprise a protective coating against weakening, loss, corrosion, galvanic corrosion, or other forms of destruction of the bodies 203 material. The coating may be selected from the group consisting of nickel, cobalt, gold, silver, tungsten, phosphorus, copper, aluminum, mixtures thereof, combinations thereof, and alloys thereof. The body 203 may be formed of a material selected from the group consisting of metal, alloy, plastic, fiberglass, wood, elastomer, ceramic, and combinations thereof.

Whereas the present invention has been described in particular relation to the drawings attached hereto, it should be understood that other and further modifications apart from those shown or suggested herein, may be made within the scope and spirit of the present invention.

What is claimed is:

1. A tool string stab guide comprising: a body having an axial length along a longitudinal axis comprising first and second section, a first plate centered along the longitudinal axis; the first section of the body is adapted for removable attachment within a diameter of a bore of a first tool string component; the second section of the body comprising a centering element with a flow channel; wherein a ratio of the axial length to the diameter is at least 2:1.

2. The stab guide of claim 1, further comprising a filter element.

3. The stab guide of claim 2, wherein the filter element is detachable.

4. The stab guide of claim 2, wherein the filter element is selected from the group consisting of perforated surfaces, bars, bristles, and screens.

5. The stab guide of claim 1, further comprising a second plate intersecting with the first plate at the longitudinal axis, wherein the plates may subdivide the bore of the tool string component into passages.

6. The stab guide of claim 5, wherein a reinforcing element is attached within the passages.

7. The stab guide of claim 1, wherein the first section of the body is attached within the bore of the first tool string component by at least one of the group consisting of threads, welds, compression, machine press, adhesives, hangers, and combinations thereof.

8. The stab guide of claim 1, further comprising a protective coating.

9. The stab guide of claim 1, wherein the stab guide is formed of a material selected from the group consisting of metal, alloy, plastic, fiberglass, wood, elastomer, ceramic, and combinations thereof.

10. The stab guide of claim 1, wherein the centering element comprises a series of diminishing diameters.

11. The stab guide of claim 10, wherein the series of diminishing diameters comprises a beginning diameter equal to the diameter of the bore of the first tool string component.

12. The stab guide of claim 1, wherein the centering element further comprises a plurality of rods projecting radially from the longitudinal axis.

13. The stab guide of claim 1, wherein the second section of the stab guide is replaceable.

14. The stab guide of claim 1, wherein the second section comprises a replaceable tip.

15. A system for aligning tool string components comprising: a body having an axial length along a longitudinal axis comprising first and second sections; a first plate centered along the longitudinal axis; the first section of the body is adapted for removable attachment within a diameter of a bore of a first tool string component; the second section of the body comprising a centering element with a flow channel, a ratio of the axial length to the diameter is at least 2:1.; wherein, when the first section is attached within the bore of the first tool string component the centering element axially aligns the first tool string component within a second tool string component before the first tool string component engages the second tool string component.

16. The system of claim 15, wherein the centering element is selected from the group consisting of a series of diminishing diameters, a plurality of radially extending rods from the longitudinal axis, and long tubules.

17. The system guide of claim 16, wherein the series of diminishing diameters has a beginning diameter less than the inside diameter of the bore of the second tool string component.

18. The system of claim 15, wherein the first section of the body is attached within the bore of the tool string component by at least one of the group consisting of threads, welds, compression, machine press, adhesives, hangers, and combinations thereof.

19. The system of claim 15, wherein the body further comprises a filter element.

20. The system of claim 15, wherein the body further comprises a protective coating.

21. The system of claim 15, wherein the second section comprises a replaceable tip.

22. The system of claim 15, wherein the body is formed of a material selected from the group consisting of metal, alloy, plastic, fiberglass, wood, elastomer, ceramic, and combinations thereof.

* * * * *